US005529046A

United States Patent [19]

Werner et al.

[11] Patent Number: 5,529,046

[45] Date of Patent: Jun. 25, 1996

[54] HIGH VOLTAGE IGNITION CONTROL APPARATUS FOR AN INTERNAL COMBUSTION ENGINE

[75] Inventors: John E. Werner; Alan J. Werner, Jr., both of Rochester, N.Y.; Mohamad M. Mojaradi, Los Angeles, Calif.; Jerry F. Adams, Waterport, N.Y.

[73] Assignee: Xerox Corporation, Stamford, Conn.

[21] Appl. No.: 369,633

[22] Filed: Jan. 6, 1995

[51] Int. Cl.[6] ..... F02P 3/12

[52] U.S. Cl. ..... 123/643

[58] Field of Search ..... 123/598, 605, 123/643, 618, 634, 652; 317/235; 361/56, 58, 86, 91; 257/261, 355, 356

[56] References Cited

U.S. PATENT DOCUMENTS

| | | | |
|---|---|---|---|
| 3,624,468 | 11/1971 | Sangster et al. | 317/235 R |
| 4,109,630 | 8/1978 | Richeson, Jr. et al. | 123/148 E |
| 4,130,096 | 12/1978 | Ford | 123/117 R |
| 4,130,097 | 12/1978 | Ford | 123/117 R |
| 4,175,506 | 11/1979 | Sakamoto et al. | 123/117 D |
| 4,343,285 | 8/1982 | Brammer et al. | 123/647 |
| 4,397,290 | 8/1983 | Tanaka et al. | 123/618 |
| 4,597,366 | 7/1986 | Chen | 123/146.5 A |
| 4,691,263 | 9/1987 | Kenny et al. | 361/58 |
| 4,918,389 | 4/1990 | Schleupen et al. | 324/399 |
| 4,996,967 | 3/1991 | Rossworm et al. | 123/598 |
| 5,050,573 | 9/1991 | Meinders et al. | 123/644 |
| 5,060,623 | 10/1991 | McCoy | 123/605 |
| 5,113,815 | 5/1992 | Ikeda | 123/146.5 B |
| 5,337,717 | 8/1994 | Scheel et al. | 123/643 |
| 5,357,233 | 10/1994 | Wada | 336/107 |

*Primary Examiner*—Raymond A. Nelli
*Attorney, Agent, or Firm*—Duane C. Basch

[57] ABSTRACT

The present invention is an apparatus for controlling the ignition of an internal combustion engine. The present invention employs a high voltage transistor, preferably a high voltage MOSFET, to switch DC voltages on the order of 1 kV to regulate the flow of current to an input tap of a primary ignition transformer or coil. The high voltage transistor is controllable by conventional logic-level voltages produced by an ignition control module.

22 Claims, 5 Drawing Sheets

HIGH VOLTAGE IGNITION CONTROL APPARATUS FOR AN INTERNAL COMBUSTION ENGINE

This invention relates generally to an ignition apparatus for an internal combustion engine, and more particularly to the use of high voltage metal-oxide semiconductor, field-effect transistor (MOSFET in n output stage of the ignition control device.

CROSS REFERENCE

The following related application is hereby incorporated by reference for its teachings:

"An Integrated Linear Ultra High Voltage device," M. Mojaradi et al., application Ser. No. 08/306,061, filed Sep. 14, 1994, now abandoned.

BACKGROUND AND SUMMARY OF THE INVENTION

The present invention is an ignition control apparatus for an internal combustion engine. More importantly, the invention utilizes the characteristics of a high voltage MOSFET device to control the operation of the ignition system at voltages not previously possible with conventional contactless (electronic) ignition systems. Accordingly, the present invention further enables the elimination, or substantial cost reduction, of components found in conventional ignition systems.

Internal combustion engine ignition systems have commonly used ignition coils powered by a low voltage, such as a 12 volt car battery. The considerably higher voltage potential required to fire a spark plug, and thus initiate combustion, is generated in a coil and distributed to the spark plugs by a spinning rotor in the distributor.

In high performance motor applications, the voltage potential needed to assure complete combustion of the air-fuel mixture is much higher than that provided by a normal ignition system. In order to over,come this problem, high voltage coils were developed, where an increased number of windings produced the increased potential but resulted in slower response times than the "normal use" ignition coils. A further complication occurs in trying to distribute the higher voltage—the mechanical contacts of the distributor and rotor are subjected to higher wear rates, necessitating more frequent replacement.

More recently, electronic ignition systems employing capacitive discharge devices and multiple coils have emerged. Frequently, the distributor has been replaced by computer modules, and the firing of the spark plugs is actually controlled by a transistor that switches the low voltage applied to the primary coil of a step-up type transformer.

Heretofore, a number of patents have disclosed ignition control devices for internal combustion engines, the relevant portions of which are hereby incorporated by reference and may be briefly summarized as follows:

U.S. Pat. No. 4,597,366 to Chart, issued Jul. 1, 1986, discloses an apparatus for distributing a high voltage arc from the high voltage ignition coil of a piston type internal combustion engine to the respective spark plug terminals by means of a high resistance, field-interrupting dielectric device which has an aperture therethrough defining a conductive path through the non-conductive dielectric device.

U.S. Pat. No. 4,175,506 to Sakamoto et al., issued Nov. 27, 1979, teaches an electric ignition control system for an internal combustion engine having a first pulse generator for producing pulses at each 180° interval of crank shaft revolution, a second pulse generator for delivering a predetermined number of pulses, such as 1800 counts, during each 180° interval, and a read only memory for producing a digital signal representing ignition timing in response to both engine speed and throttle opening. When the first counter circuit has counted the number of the second pulse generator pulses equal to the value of the digital signal from the memory, the primary current of an ignition coil applied from a battery to the primary coil thereof is interrupted for producing a high voltage to establish an ignition spark across the gap of a spark plug.

U.S. Pat. No. 4,130,097 to Ford, issued Dec. 19, 1978, discloses a closed loop electronic ignition system for internal combustion engines, in which a comparison is made between a first and a second signal to maintain coincidence between the signals, so that the second stage of combustion always occurs at a fixed predetermined crank angle, irrespective of the speed and load on the engine, as well as all other parameters which can affect ignition timing. U.S. Pat. No. 4,130,096, also to Ford, issued Dec. 19, 1978, teaches a similar closed loop electronic ignition system where if non-coincidence is detected between the two signals, the ignition timing is either advanced or retarded so as to maintain coincidence between the signals.

U.S. Pat. No. 4,109,630 to Richeson, Jr. et. al., issued Aug. 29, 1978, discloses an electronic ignition system for an internal combustion engine having a timing signal source comprising an oscillator for providing a carrier signal; an electronic network connected to the oscillator; and a detector for demodulating a modulated carrier signal and providing an output signal indicative of a predetermined rotational position of the engine. The output signal is supplied to switching circuitry for switching the primary of an ignition coil and providing a high voltage output pulse at a time synchronized with said predetermined rotational position of the engine.

U.S. Pat. No. 4,918,389 to Schleupen et. al., issued Apr. 17, 1990, teaches the detection of misfiring in internal combustion engines by detecting the voltage induced in the primary winding of the ignition coil, and comparing it to reference voltage which represents normal firing.

Of particular relevance are those ignition devices for internal combustion engines that employ transistor components therein, for example:

U.S. Pat. No. 5,113,815 to Ikeda, issued May 19, 1992, discloses an ignition control apparatus for an internal combustion engine in which the engine can not be started without the operation of a switch unit which may further include a control element in the form of a resistor or a transistor.

U.S. Pat. No. 5,050,573 to Meinders et. al., issued Sep. 24, 1991, teaches an ignition device for an internal combustion engine Including a preselector stage and an output stage for controlling the flow of current through the primary winding of an ignition transformer. The ignition device is particularly suited for an externally ignited internal combustion engine. The output stage comprises a pnp-transistor having its collector terminal directly coupled to a ground connection of the ignition device to improve proper loss dissipation. A decoupling device is coupled between the preselector stage and the output stage, and is provided to protect the preselector stage by decoupling it from the output stage.

U.S. Pat. No. 4,397,290 to Tanaka et. al., issued Aug. 9, 1983, discloses a supply-voltage-compensated contactless ignition system for internal combustion engines that includes an input transistor operable in response to an engine ignition signal so as to control the operation of a power transistor to control the energization of an ignition coil; with the operating level of the input transistors being varied with variation in the supply voltage. The system further includes a current mirror circuit having first and second current shunt paths including first and second transistors which are connected in parallel with a voltage clamping device such that the each current path shunts a current increased over that of the other in response to a rise of the supply voltage beyond a predetermined value.

U.S. Pat. No. 4,343,285 to Brammer et. al., issued Aug. 10, 1982, teaches a Hall generator integrated circuit in a transistor-controlled ignition system of an internal combustion engine and an integrated circuit board which carries the circuit elements for overvoltage protection, amplification, and the power output stage mounted together in one building block. Preferably, the conductive element and the permanent magnet of the Hall generator are also integrated into the building block as is a pressure sensor. The output of the pressure sensor is directly applied to the circuits in the printed circuit board. The unit occupies little space and eliminates the need for external leads interconnecting the ignition coil and the output circuit.

In accordance with the present invention, there is provided a contactless ignition apparatus for an internal combustion engine, comprising:

a high voltage DC power source for supplying direct current at a first potential;

an ignition transformer including a core, a primary coil associated with the core and connected to said high voltage DC power source to receive the direct current at a first potential therefrom and a secondary coil, also associated with the core, and adapted to produce a DC voltage of a second potential, greater than the first potential, in response to the application of the direct current at a first potential to the primary coil;

a spark plug, connected to the secondary coil of said ignition transformer, for generating a spark to ignite an air-fuel mixture in the internal combustion engine in response to the DE voltage of the second potential;

a high voltage transistor, connected in series with said high voltage DC power source and the primary coil of said ignition transformer, for controlling the passage of the direct current of the first potential through the primary coil of said ignition transformer in response to a logic signal applied thereto; and an ignition control module, connected to said high voltage transistor, for generating a low voltage logic signal to control the passage of the direct current of the first potential through the primary coil of said ignition transformer so as to control ignition of said spark plug.

In accordance with another aspect of the present invention, there is provided a contactless ignition apparatus, comprising:

a high voltage DC power source for supplying a DC voltage of at least 1000 volts;

an ignition transformer for producing a stepped-up DC voltage of at least 20,000 volts in response to the DC voltage, the stepped-up DC voltage being suitable to drive an ignition device;

a high voltage transistor, connected in series with said high voltage DC power source and said ignition transformer, to control the application of the DC voltage to said ignition transformer in response to a logic signal applied thereto; and an ignition control module, electrically connected to said high voltage transistor, for generating the logic signal to control the high voltage transistor and thereby the application of the DC voltage to said ignition transformer.

One aspect of the present invention is based on the observation of problems with conventional ignition systems, where components therein are subject to wear, or are necessarily complex and expensive in order to handle the very high voltages needed to drive spark plugs or equivalent ignition devices. This aspect is based on the discovery of the use of high voltage MOSFETs to switch high voltages and thus alleviate these problems. Use of high voltage MOSFETs enables switching of higher primary voltages, by an ignition computer or control module, thereby eliminating the need for contact switching components, and/or reducing the ignition coil sizes.

This technique can be implemented, for example, by employing a high voltage MOSFET to control the firing of one or more spark plugs in an internal combustion ignition system. Furthermore, an ignition control apparatus implementing the invention may include spark plugs wherein a small secondary coil is integrated into the spark plug package or the high voltage distribution circuitry itself. The technique described is advantageous because it improves reliability and performance, while decreasing the complexity and cost, of electronic ignition systems for internal combustion engines.

Figure 1:
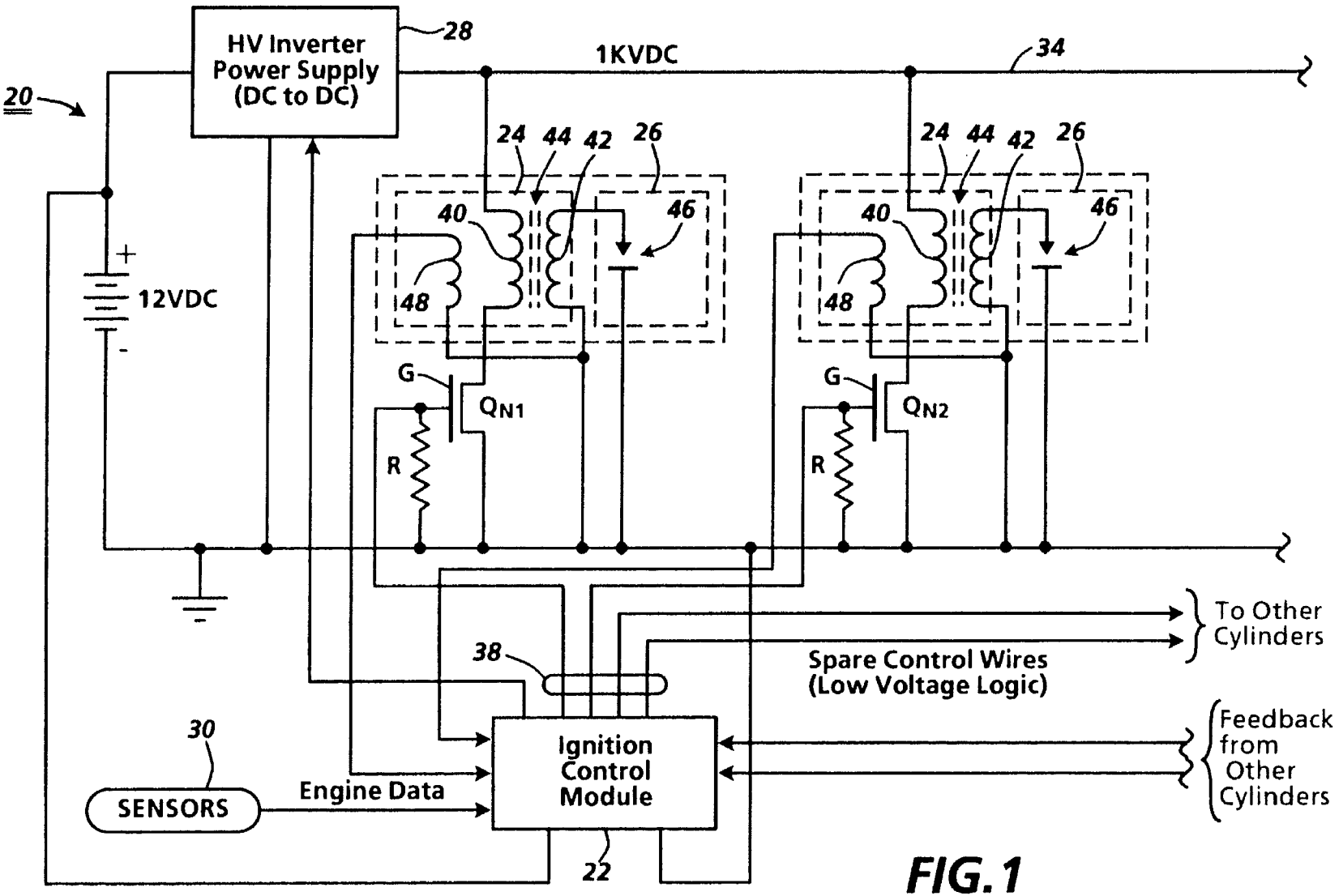
FIG. 1 is a schematic block diagram of a contactless electronic ignition system in accordance with the present invention.

The present invention will be described in connection with a preferred embodiment, however, it will be understood that there is no intent to limit the invention to the embodiments described. On the contrary, the intent is to cover all alternatives, modifications, and equivalents as may be included within the spirit and scope of the invention as defined by the appended claims.

DESCRIPTION OF THE PREFERRED EMBODIMENT

For a general understanding of the present invention, reference is made to the drawings. In the drawings, like reference numerals have been, used throughout to designate identical elements. In describing the present invention, the following term(s) have been used in the description.

The term "data" refers herein to physical signals that indicate or include information, and in particular data related to the operation of an internal combustion engine.

"Circuitry" or a "circuit" is any physical arrangement of matter that can respond to a first signal at one location or time by providing a second signal at another location or time.

An "ignition control module" or "controller" is a physical system that processes internal combustion engine data. A "controller" is any component or system that can process input data to produce output in the form of signals, and may include one or more central processing units or other processing components.

Any two components are "connected" when there is a combination of circuitry that can transfer signals from one of the components to the other. For example, two components are "connected " by any combination of connections between them that permits transfer of signals from one of the components to the other including, but not limited to direct electrical connections, and opto-electronic (isolation) connections.

Internal combustion engine ignition systems have typically employed ignition coils powered by a low voltage, such as a 12 volt car battery. However, the potential necessary to cause a spark plug to fire is significantly higher than 12 volts, and is typically generated in an ignition transformer, commonly referred to as a coil, and then distributed to the spark plugs where the resulting spark ignites an air-fuel mixture in the cylinder. Unfortunately, one drawback of such systems is the large transformer (coil) needed to accomplish the significant step-up in the DC voltage necessary to generate a spark at the sparkplug. Moreover, as the size of the transformer increases (i.e., more secondary windings) the response time of the transformer decreases.

In high performance engine applications, the increased voltage potential needed to assure complete combustion of the air-fuel mixture is much higher than can be provided by common ignition systems. In order to overcome this problem, the present invention employs a high voltage transistor, preferably a high voltage MOSFET, to switch higher DC voltages than are typically used in automotive or similar internal combustion engines.

Referring to FIG. 1, represented therein is an exemplary high performance, internal combustion engine ignition system 20 employing the high performance, low cost components of the present invention. In particular, system 20 is controlled by an ignition control module (a controller) 22 or similar data processing device. Ignition control module 22 is preferably a microprocessor commonly employed in electronic ignition control systems. The ignition control module receives engine data from various sensors 30 associated with the internal combustion engine (not shown), including for example, vacuum sensors, timing sensors, fuel mixture sensors, battery voltage sensors, combustion chamber compression sensors and other sensors well-known in relation to internal combustion engines. In response to the engine data provided by sensors 30 and a feedback winding as will be described hereafter, ignition control module 22 generates logic signals on lines 38 that control the firing of spark plugs indicated generally by reference numeral 26, and possibly other components of the engine.

In the high performance system depicted, a single ignition transformer, or coil, 24 is used to drive each spark plug 26. More specifically, high voltage power supply 28 produces a primary DC voltage (+HV) of at least 1000 volts (1 kV) in response to a low voltage input of approximately 12 volts, preferably provided by a conventional automobile battery. High voltage power supply 28, comprising standard inverter technology, generates the primary DC voltage that is applied by conductors 34 to one tap of a primary coil 40 in ignition transformer 24, the other tap thereof being connected to transistor $Q_{N1}$ or $Q_{N2}$, for the respective cylinders. Transistors $Q_{N1}$ and $Q_{N2}$ (generally referred to as $Q_N$) are preferably high voltage N-MOS FET transistors as will be described in further detail with respect to FIG. 2.

In response to a low voltage logic signal, preferably in the range of 0–24 volts, generated by ignition control module 22 and applied to the gates (G) of the high voltage N-MOS FETs by conductors 38, transistors $Q_{N1}$ and $Q_{N2}$ regulate the flow of current from their drains to their sources. For example, when a high logic signal is present on gate G, the high voltage DC (+HV) is conducted through the MOSFET $Q_N$ to allow current to pass through primary coil 40 of ignition transformer 24, in series therewith, thereby driving the coil and creating a flux in core 44. When a low logic signal (0 volts) is present on gate G, no current is allowed to pass from the drain to the source of transistor $Q_N$. As illustrated, high voltage transistors $Q_N$ are preferably biased using a biasing resistor R. Biasing resistor R is connected between the gate and source of each transistor to establish appropriate operating conditions for the transistors and to ensure that they are "switched off" when no signal is present at the gate.

Ignition transformer 24 includes a primary winding 40, a secondary winding 42 and core 44. Using a primary winding potential (+HV) of at least 1 kV, the ratio of primary to secondary windings is only about 20:1 to achieve the 20 kV necessary to drive spark plugs in conventional internal combustion engines. The smaller coil is not only easier to make and package, but it could also be produced as an integral part of the spark plug, wire, connector, or a combination of these. Thus, upon the application of the DC voltage +HV to the primary windings 40 of coil 24, as regulated by transistor $Q_N$, the coil generates a stepped-up voltage in excess of 20 kV in secondary windings 42. The stepped-up voltage, in turn, is sufficient to jump gap 46 of spark plug 26 and cause ignition of the air fuel mixture in the engine cylinder (not shown). Hence, the firing of each coil is controlled by a high voltage N-MOS FET ($Q_N$), where an advantage is that it can control the high voltage applied to the ignition transformer and thereby reduce the voltage multiplication necessary to produce the higher secondary voltage.

In a preferred embodiment, ignition transformer 24 and switching transistor $Q_N$ would be arranged to allow the spark plug to fire when the switch is closed, rather than the traditional, flyback type ignition, where the spark plug fires as the switch opens. Such an arrangement will avoid subjecting transistor $Q_N$ to excessively high voltages when turned off. Moreover, if the primary leakage inductance of ignition transformer 24 is reasonably low, which may be easily accomplished as the turns ratio approaches unity, the turn-off voltage in the primary winding 40 could also be maintained at a low level through appropriate selection of well-known snubber devices.

The design of ignition transformer 24 is impacted by several factors. Specifically, the core area must be sufficient to sustain the volt.seconds/turn anticipated in the circuit, or core saturation will occur. Next, the window area of the core must allow sufficient room for the primary and secondary turns to be wound, and the overall core size must be such that an unacceptable core temperature rise can be avoided. The core size needed to meet these latter constraints could allow significant size reduction over traditional ignition coil designs, except for the requirement of avoiding core saturation as described above. Therefore a further enhancement to the aforedescribed embodiment is preferred.

In particular, the preferred embodiment includes a feedback winding 48 added to core 44 of ignition transformer 24.

The feedback winding would preferably be comprised of a few turns of small gauge wire wound on the transformer core and closely linked magnetically to the secondary winding. The purpose of the feedback winding is two-fold. First, a DC bias voltage would be applied to feedback winding 48 in a polarity such that it drives core 44 to saturation in the direction opposite that which the normal primary coil drives the core. A current limiting circuit (not shown) should be employed to limit the current in feedback winding 48. The turns ratio of the feedback to secondary windings would preferably be such that the voltage developed at secondary winding 42 would not be sufficient to cause a spark plug to fire. The act of driving the core to saturation in the "negative" flux direction would have the effect of allowing core 44 to swing through twice the flux change when the primary winding 40 is activated before saturating in that (positive) direction. This means that the spark could be sustained twice as long. Conversely, core 44 could be made half as large as would be necessary without the addition of this winding, while maintaining the same spark duration.

Second, feedback winding 48 could also be employed to monitor the state of the ignition transformer core. When the primary winding 40 is activated by switching transistor $Q_N$ a voltage would be developed in the feedback winding 48 just as it would be in the secondary winding. As the ignition transformer core saturates the voltage would disappear in both the feedback and secondary windings. A circuit that monitors the voltage in tile feedback winding could determine at what point the ignition transformer core saturated and terminate the passage of the +HV current through primary winding 40. As core 44 resets, the voltage across the feedback winding would at first be relatively large—as the core supports the resetting potential applied via that winding. However, as the core saturates in the reverse polarity, the voltage across the feedback winding would again collapse (by virtue of the current limiting feature of the feedback winding drive circuit). At that point the +HV current could again be applied to drive the primary winding. The effect of the aforedescribed sequencing and feedback enhancement would be to deliver multiple sparks in a given spark period, the durations thereof being determined as a function of the design of the ignition coil, and the off time durations being determined by the design of the feedback winding drive circuitry in combination with the design of the actual transformer windings.

As an alternative means of resetting the ignition transformer core 44, the core could be self-reset by allowing the voltage in the primary winding to exceed the applied DC voltage of 1 kV for a short period. This would cause the voltage impressed across the MOSFET switching transistors $Q_N$ to be significantly higher, but might allow quicker core reset, which in turn would enable more spark firings to occur in a given time period. The voltage across the switching transistors, and therefore the reset time of the core, would also be determined by the selection of well-known snubber elements (not shown) to be placed across the source-drain of switching transistors $Q_N$. In this alternative reset scheme, as in the prior scheme, the voltage at feedback winding 48 would change dramatically as core 44 reset itself, so that the feedback winding could again be used to monitor the state of the core. As yet another alternative embodiment, a combination of these two core reset schemes might be implemented. The core self reset scheme could be used to partially reset core 44 to a net zero flux. Beyond that point the feedback winding could be used to further drive the core in the negative direction.

The present invention may find further application in high output, high performance engines where secondary ignition potentials in excess of 35 kV are commonly used to assure complete ignition of the air-fuel mixture. In particular, the smaller (smaller winding ratio) coil 24 enabled by the high voltage switching capability of the present invention will allow faster rise and fall times for the secondary voltage. In turn, this facilitates easier control of the firing of the spark plugs, and the possibility of providing multiple sparks for each firing of the cylinder; an advantage that performance engine builders readily acknowledge results in increased power and efficiency for such engines.

As noted above, by feeding the signals generated in feedback coil 48 back to ignition control module 22, the signal generated by the feedback coil may be used to control the duration of the spark. Similarly, the signal may be used to control the output of the high voltage power supply 28, or more specifically the voltage of spark. The output can be controlled in response to the signal from the feedback coil, and is effected by the condition of the feedback coil, the condition of the spark plug, the battery condition, the condition of the air/fuel mixture in the combustion chamber, and the combustion chamber compression (e.g., the density of the air/fuel mixture which can be affected by turbo charging).

Figure 2:
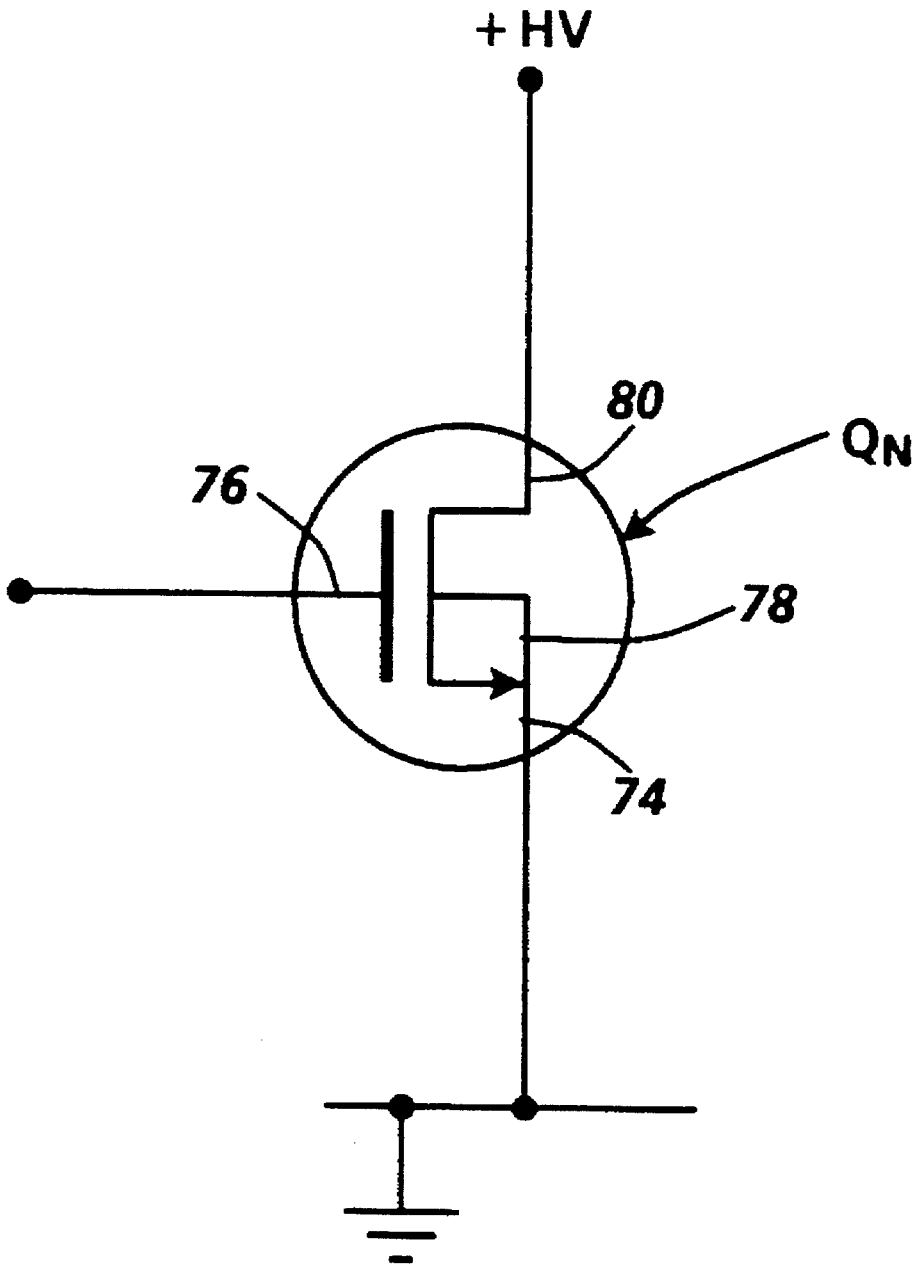
FIG. 2 is a detailed illustration of the MOSFET switching device illustrated in FIG. 1.

Referring now to FIG. 2, the details of an integrated linear high voltage transistor $Q_N$ are shown. In a preferred embodiment, the drain 80 of a high voltage n-channel MOSFET (metal-oxide-semiconductor field-effect transistor) $Q_N$ is connected to a primary coil tap of ignition transformer 24 which has a high voltage (+HV) applied to the other primary coil tap thereof. The source 74 of the transistor $Q_N$ is connected to a common ground. While the source-drain potential is preferably a fixed voltage, the absolute value of the source-drain potential can be selected over a range of up to approximately 1700 volts for the n-channel device. Accordingly, a potential of greater than 1 kV but preferably less than 1.7 kV may be employed for the high voltage power supply.

An important feature of the high voltage MOSFET is that the substrate 78 of the transistor $Q_N$ is "floating," so that the substrate 78 is neither connected to any power supply nor grounded. By having the substrate 78 floating, the source 74 can be connected to the substrate 78 whereby all voltages applied to the substrate will be through its connection with the source 74. This arrangement generates a linear source follower transistor. This configuration takes the transistor $Q_N$ into its saturation region which allows the circuit to operate with a gain of approximately 1 over the whole voltage range from 0 to 1700 volts. This device has a high linearity and high precision. In order to achieve linearity, "body effect " should be eliminated. The "body effect", which is the potential between the substrate 78 and the source 74, causes a shift in the threshold voltage of the transistor and increases nonlinearity. In this configuration, the source of transistor $Q_N$ is connected to its substrate 78, which is floating, to eliminate the body effect. The high voltage n-channel device of this invention may be produced using a 3-micron ultra-high-voltage CMOS technology, and is capable of handling absolute voltage differences up to 1.7 kV.

Figure 3:
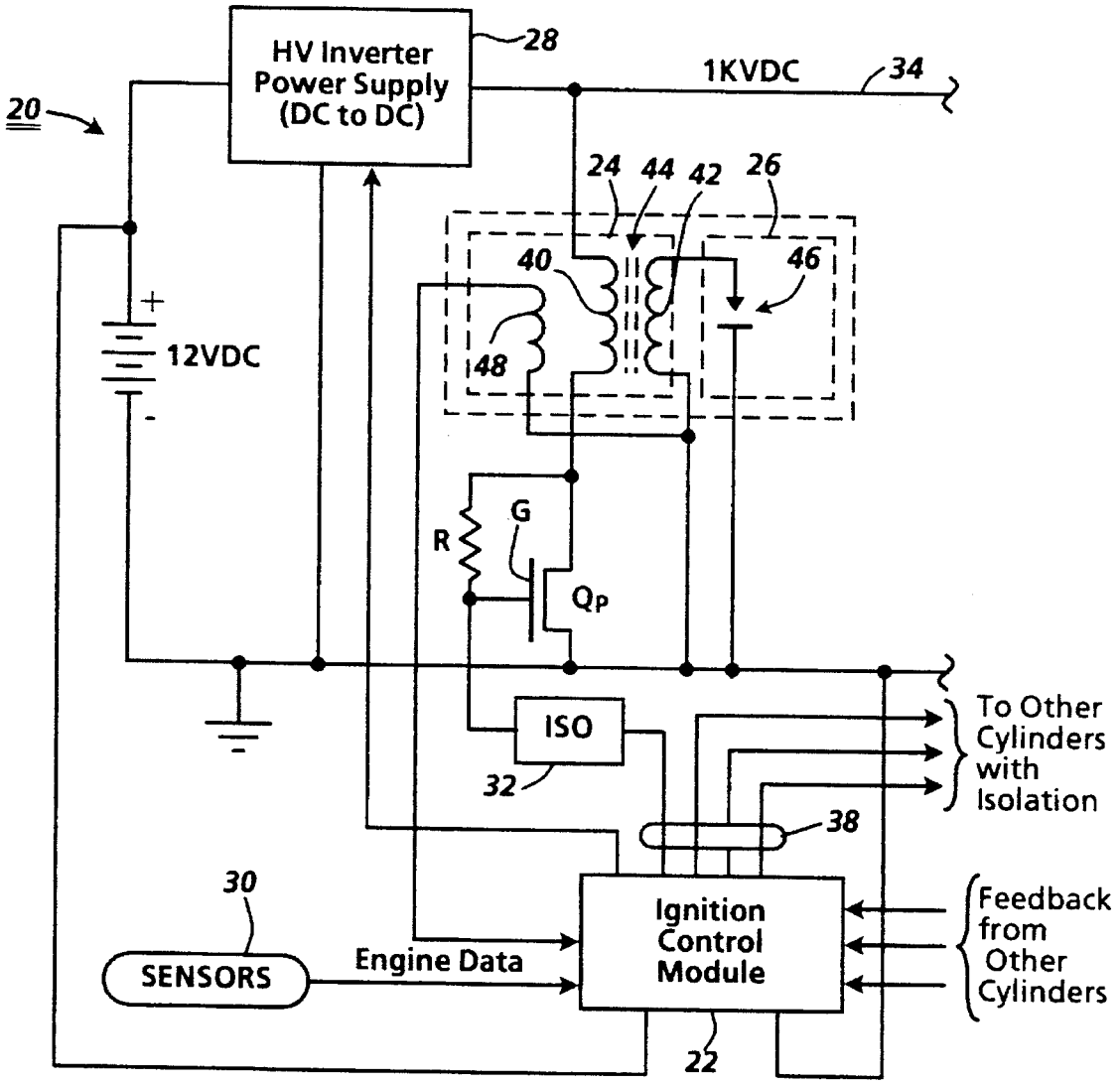
FIGS. 3–5 are partial block diagrams of alternative embodiments of a contactless electronic ignition systems in accordance with the present invention.
Figure 5:
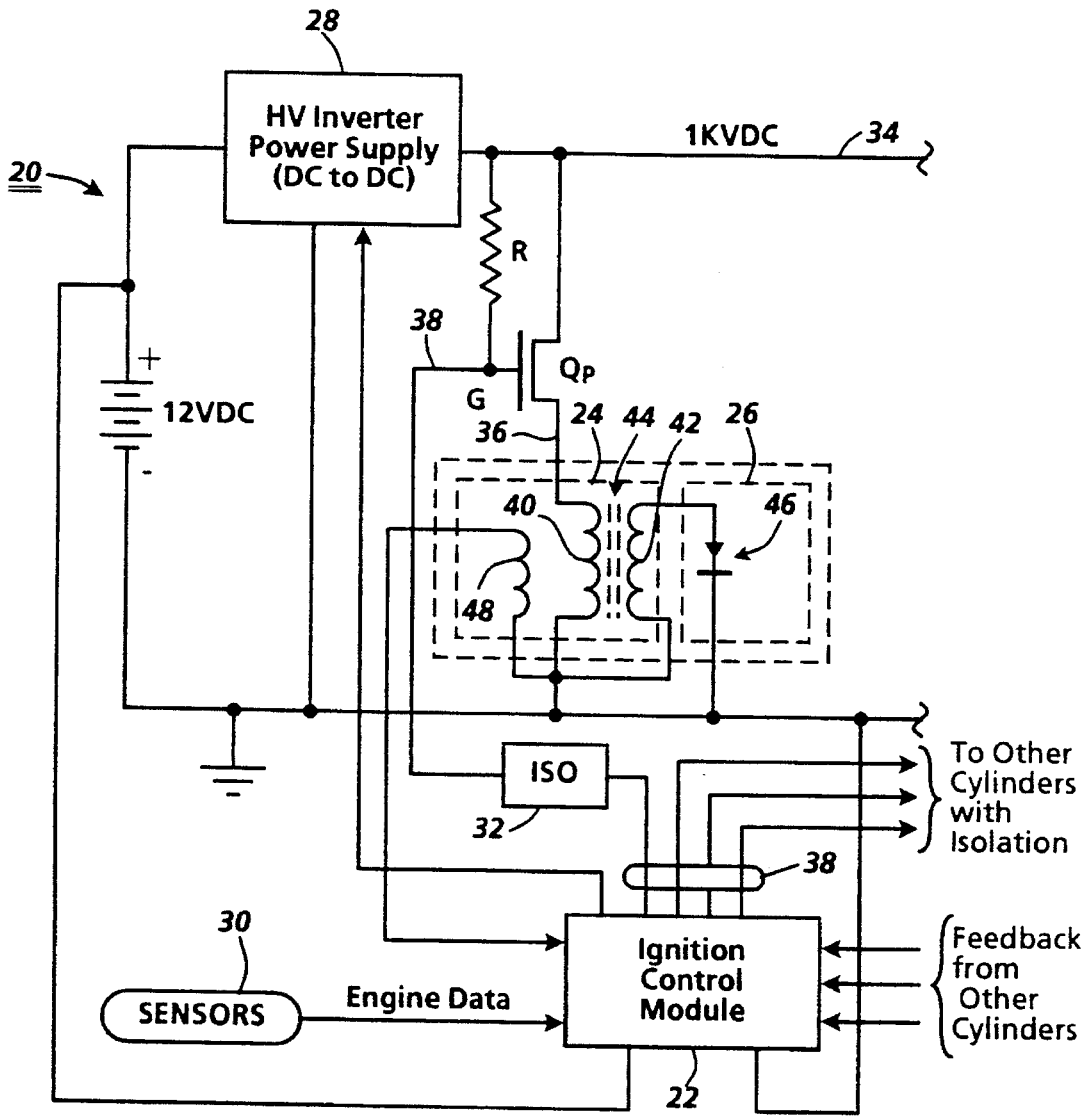

Alternatively a p-channel MOSFET may be employed in place of the aforedescribed n-channel MOSFET as illustrated in FIGS. 3 and 5. A p-channel MOSFET ($Q_p$) with the same geometry of an n-channel MOSFET handles positive voltage differences with a lower absolute value. For example, the absolute value of the maximum voltage difference is approximately 1200 volts. Accordingly, either p-channel or n-channel MOSFETs may be employed in the present invention. If it is desirable to use a p-channel MOSFET while being able to switch potentials similar to the potentials that the n-channel MOSFET handles, regardless of the polarity of the potential, the p-channel MOSFET may be designed with larger geometries. A p-channel MOSFET with larger geometries can handle higher positive voltage differences. It should be understood that the intergrated linear high voltage device of this invention may utilize either enhancement or depletion modes of both n-channel and p-channel MOSFETs. Furthermore, it should also be understood that the voltage handling capability of both the n-channel MOSFET and the p-channel MOSFET can be improved by changing design parameters, such as using higher resistivity substrate material or lower doping concentration of the junctions, or by using any technology which can produce higher voltage MOS transistors. In this instance the voltage difference handled by either the n-channel MOSFET or the p-channel MOSFET may substantially exceed the ±1700 volt capability described herein.

Figure 4:
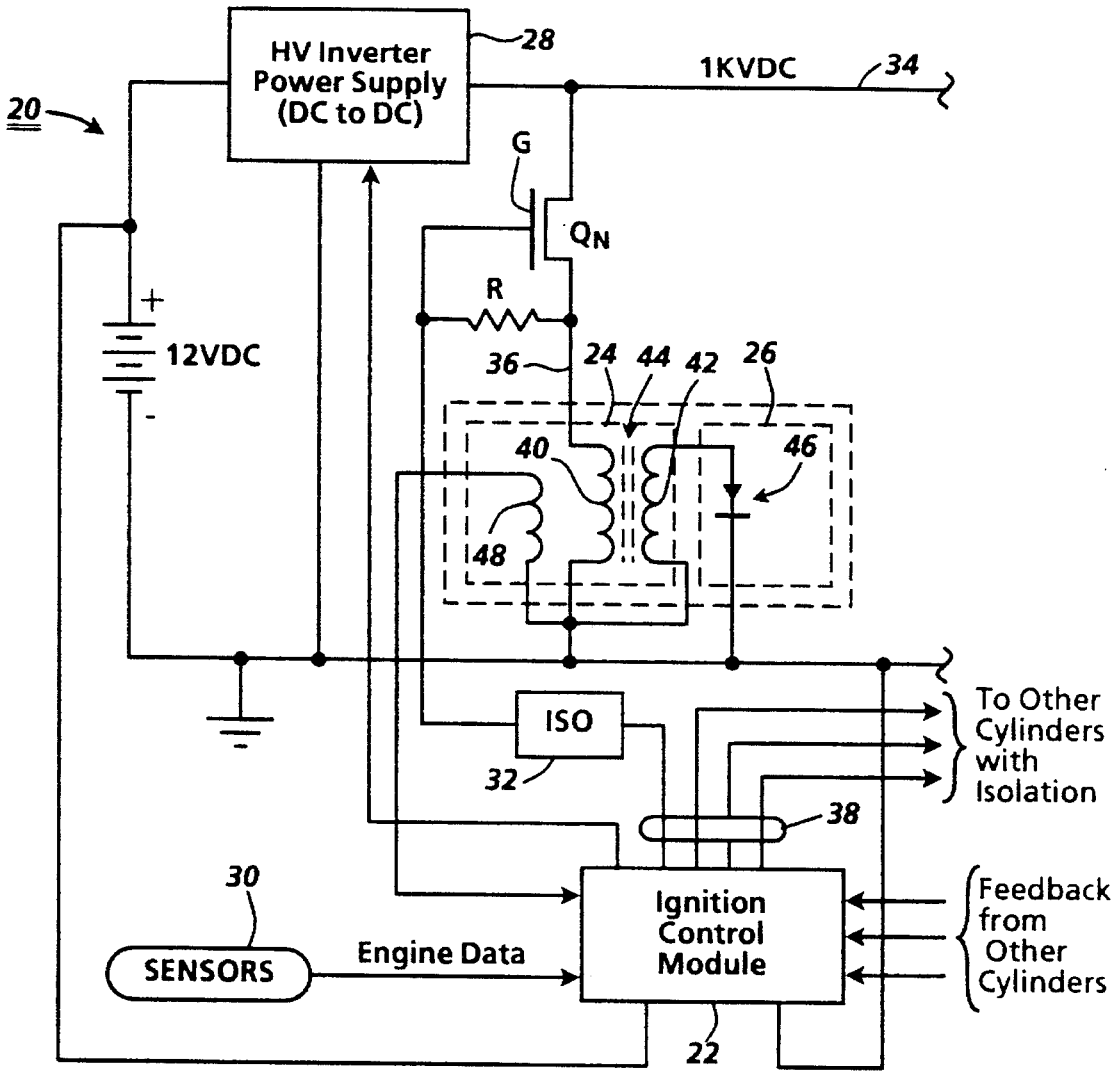

Referring now to FIGS. 3 through 5, represented therein are portions of alternative high performance; internal combustion engine ignition systems 20, each system employing the high performance, low cost components of the present invention in slightly different circuit configurations. In particular, ignition system 20 of FIG. 3 is again controlled by an ignition control module 22. Module 22 receives engine data from various sensors 30 and generates logic signals on lines 38 to control the firing of spark plug 26, or an equivalent ignition device. Control of the firing of the spark plugs is accomplished by application of the low voltage logic signals, applied via a DC isolation device 32, to the gate (G) of the high voltage P-MOS FET $Q_p$ by conductor 38. DC isolation device 32 may be any of a number of well-known devices capable of isolating the ignition control module from the high voltage DC, for example an opto-electronic isolator. As with the circuit depicted in FIG. 1, the high voltage transistor is connected on the ground (or negative) side of the primary coil 40 in ignition transformer 24. Hence, the general operation of the ignition system employing the P-MOS switching device $Q_p$ would be as described above.

FIGS. 4 and 5 illustrate additional alternative embodiments of ignition control system 20 employing the previously described high voltage transistors $Q_N$ or $Q_p$, respectively. In both of the illustrated embodiments, the high voltage transistors are connected in series between high voltage power supply 28 and the tap of primary coil 40 in ignition transformer 24. In the systems illustrated therein high voltage power supply 28 produces a primary DC voltage (+HV) of at least 1000 volts in response to the low voltage input of approximately 12 volts, preferably provided by a conventional automobile battery or power generating system. High voltage power supply 28 generates the primary DC voltage that is applied to the transistors $Q_N$ and $Q_p$ in FIGS. 4 and 5 respectively, via conductors 34. Hereagain, in response to the low voltage logic signal generated by ignition control module 22, applied via DC isolation devices 32 to the gates (G) of the high voltage MOSFETs ($Q_N$ or $Q_p$) by conductors 38, the high voltage MOSFETs regulate the flow of current therethrough.

For example, referring specifically to FIG. 4, when a high logic signal is present on gate G, the high voltage DC (+HV) is conducted through the MOSFET $Q_N$ to pass to the source and, via conductor 36 to an input tap of primary coil 40 in ignition transformer 24. When a low logic signal (0 volts) is present on gate G, no current is allowed to pass from the drain to the source. In one embodiment, an integrated ignition apparatus similar to that described in U.S. Pat. No. 5,357,233 to Wada, issued Oct. 18, 1994 and hereby incorporated by reference, may be employed as the ignition transformer 24 to step-up the DC voltage switched by transistor $Q_N$ or $C_p$ in the present invention.

Furthermore, in the alternative embodiments illustrated by FIGS. 4 and 5, the ignition transformer 24 and switching transistors ($Q_N$ or $Q_p$) would preferably be arranged to allow the spark plug to fire when the switch is closed. As previously described, such an arrangement will avoid subjecting the high voltage transistors to excessively high voltages when turned off.

In recapitulation, the present invention is an apparatus for controlling the ignition of an internal combustion engine. The present invention employs a high voltage transistor, preferably a high voltage MOSFET, to switch DC voltages on the order of 1 kV to regulate the flow of current to an input tap of a primary ignition transformer or coil. The high voltage transistor is controllable by conventional logic-level voltages produced by an ignition control module or equivalent data processor.

It is, therefore, apparent that there has been provided, in accordance with the present invention, an apparatus for controlling the ignition of an internal combustion engine. While this invention has been described in conjunction with preferred embodiments thereof, it is evident that many alternatives, modifications, and variations will be apparent to those skilled in the art. Accordingly, it is intended to embrace all such alternatives, modifications and variations that fall within the spirit and broad scope of the appended claims.

We claim:

1. A non-capacitive, contactless ignition apparatus for an internal combustion engine, comprising:

a high voltage DC power supply for supplying direct current at a first potential of at least 1000 volts;

an ignition transformer including a core, a primary coil associated with the core and connected directly to said high voltage DC power supply to receive the direct current at a first potential therefrom and a secondary coil, also associated with the core, and adapted to produce a DC voltage of a second potential, greater than the first potential, in response to the application of the direct current at a first potential to the primary coil;

a spark plug, connected to the secondary coil of said ignition transformer, for generating a spark to ignite an air-fuel mixture in the internal combustion engine in response to the DC voltage of the second potential;

a high voltage transistor, connected in series with said high voltage DC power supply and the primary coil of said ignition transformer, for controlling the passage of the direct current of the first potential through the primary coil of said ignition transformer in response to a low voltage logic signal applied thereto; and an ignition control module, connected to said high voltage transistor, for generating a low voltage logic signal to control the passage of the direct current of the first potential through the primary coil of said ignition transformer so as to control ignition of said spark plug.

2. The contactless ignition apparatus of claim 1, wherein said high voltage transistor is a metal-oxide-semiconductor field-effect transistor.

3. The contactless ignition apparatus of claim 2, wherein said metal-oxide-semiconductor field-effect transistor is a n-channel device.

4. The contactless ignition apparatus of claim 1, wherein said metal-oxide-semiconductor field-effect transistor is a p-channel device.

5. The contactless ignition apparatus of claim 2, wherein the second potential is at least 20,000 volts.

6. The contactless ignition apparatus of claim 5, wherein the primary coil has windings and the secondary coil has windings, and where the ratio of the number of windings of the primary coil to the number of windings of the secondary coil does not exceed 20:1.

7. The contactless ignition apparatus of claim 1, wherein said ignition transformer is integrally incorporated within said spark plug.

8. The contactless ignition apparatus of claim 1, further comprising a direct current isolation device interposed in a connection between said ignition control module and said high voltage transistor to isolate said ignition control module from the DC voltage of a first potential.

9. The contactless ignition apparatus of claim 1, wherein said ignition transformer further comprises a feedback coil associated with the core.

10. The contactless ignition apparatus of claim 9, wherein said feedback coil comprises a plurality of turns of small gauge wire wound on the core, said feedback coil being closely linked magnetically to the secondary coil.

11. The contactless ignition apparatus of claim 10, wherein a DC bias voltage is applied to said feedback coil to drive the core to saturation in a direction opposite that in which the core is driven by the primary coil.

12. The contactless ignition apparatus of claim 11, wherein the number of turns in the feedback coil is sufficiently less than the number of turns in secondary coil so that the voltage developed at the secondary coil upon application of the DC bias voltage to said feedback coil is not sufficient to cause said spark plug to fire.

13. The contactless ignition apparatus of claim 10, wherein said feedback coil is connected to said ignition control module so as to provide a signal to said ignition control module to enable said ignition control module to monitor a flux state of the ignition transformer core.

14. The contactless ignition apparatus of claim 13, wherein a duration of the spark generated by said spark plug is controlled by said ignition control module as a function of the signal from said feedback coil.

15. The contactless ignition apparatus of claim 13, wherein said ignition control module further regulates the first potential output by said high voltage DC power source as a function of the signal from said feedback coil.

16. The contactless ignition apparatus of claim 1, wherein said high voltage transistor is connected between an output of the high voltage DC power source and the primary coil of said ignition transformer.

17. The contactless ignition apparatus of claim 1, wherein said high voltage transistor is connected between the primary coil of said ignition transformer and a common ground.

18. The contactless ignition apparatus of claim 1, further comprising:

a second ignition transformer including a core, a primary coil associated with the core and connected to said high voltage DC power source to receive the direct current at a first potential therefrom and a secondary coil, also associated with the core, and adapted to produce a DC voltage of a second potential, greater than the first potential, in response to the application of the direct current at a first potential to the primary coil;

a second spark plug, connected to the secondary coil of said second ignition transformer, for generating a spark to ignite an air-fuel mixture in a second cylinder of the internal combustion engine in response to the DC voltage of the second potential; and a second high voltage transistor, connected in series with said high voltage DC power source and the primary coil of said second ignition transformer, for controlling the passage of the direct current of the first potential through the primary coil of said second ignition transformer in response to a second low voltage logic signal applied thereto;

wherein said ignition control module is further connected to said second high voltage transistor and generates the second low voltage logic signal to control the passage of direct current of the first potential through the primary coil of said second ignition transformer so as to control ignition of said second spark plug.

19. A non-capacitive contactless ignition apparatus, comprising:

a high voltage DC power source for supplying a DC voltage of at least 1000 volts;

an ignition transformer for producing a stepped-up DC voltage of at least 20,000 volts in response to the DC voltage, the stepped-up DC voltage being suitable to drive an ignition device;

a high voltage transistor, connected in series with said high voltage DC power source and said ignition transformer, to control the application of the DC voltage to said ignition transformer in response to a logic signal applied thereto; and an ignition control module, electrically connected to said high voltage transistor, for generating the logic signal to control the high voltage transistor and thereby the application of the DC voltage to said ignition transformer.

20. The contactless ignition apparatus of claim 19, wherein said high voltage transistor is a metal-oxide-semiconductor field-effect transistor.

21. The contactless ignition apparatus of claim 20 wherein said ignition transformer comprises a core and a primary coil, a secondary coil and a feedback coil all associated with the core; and where said feedback coil includes a plurality of turns of small gauge wire wound on the core, said feedback coil being closely linked magnetically to the secondary coil and electrically connected to said ignition control module.

22. The contactless ignition apparatus of claim 21 wherein said feedback coil is connected to said ignition control module and provides a signal thereto so as to enable said ignition control module to monitor a flux state of the ignition transformer core, and where said ignition control module controls, as a function of the flux state of the ignition transformer core, duration of a spark generated by the ignition device and the potential of the DC voltage supplied by said high voltage DC power source.

* * * * *